US005862033A

United States Patent [19]

Geislinger et al.

[11] Patent Number: 5,862,033

[45] **Date of Patent: *Jan. 19, 1999**

[54] EXCITER CIRCUIT

[75] Inventors: Dale F. Geislinger, Norwich; Howard V. Bonavia, Groton, both of N.Y.

[73] Assignee: Unison Industries Limited Partnership, Jacksonville, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 800,910

[22] Filed: Feb. 13, 1997

[51] Int. Cl.[6] ..... F02P 3/09

[52] U.S. Cl. ..... 361/257

[58] Field of Search ..... 361/247, 253, 361/256, 257, 263

[56] References Cited

U.S. PATENT DOCUMENTS

| | | | |
|---|---|---|---|
| 4,129,895 | 12/1978 | Witting | 361/257 |
| 5,065,073 | 11/1991 | Frus . | |
| 5,084,800 | 1/1992 | Hijikata | 361/257 |
| 5,148,084 | 9/1992 | Frus . | |
| 5,245,252 | 9/1993 | Frus et al. . | |
| 5,347,422 | 9/1994 | Smith et al. | 361/253 |
| 5,399,942 | 3/1995 | Frus . | |
| 5,488,536 | 1/1996 | Bonavia et al. | 361/253 |
| 5,510,952 | 4/1996 | Bonavia et al. | 361/251 |
| 5,530,617 | 6/1996 | Bonavia et al. | 361/253 |
| 5,561,350 | 10/1996 | Frus et al. . | |
| 5,654,868 | 8/1997 | Buer | 361/256 |

*Primary Examiner*—Fritz Fleming
*Attorney, Agent, or Firm*—Leydig, Voit & Mayer, Ltd.

[57] ABSTRACT

An ignition system exciter circuit includes a storage capacitor; a charging circuit for charging the capacitor; a discharge circuit connectable to an igniter plug; and a first switching circuit for controlling discharge of the capacitor through the discharge circuit and plug; the discharge circuit comprising a step-up transformer for transforming voltage stored on the capacitor to a higher voltage across the igniter plug when the first switching circuit is closed; the transformer having a primary winding and a secondary winding, with the secondary winding having a first terminal that can be coupled to a first terminal of the igniter plug and a second terminal that can be coupled to a second terminal of the igniter plug; and a second switching circuit that is responsive to a voltage transition across the igniter plug and that prevents the transformer primary and secondary windings from conducting spark discharge current.

22 Claims, 1 Drawing Sheet

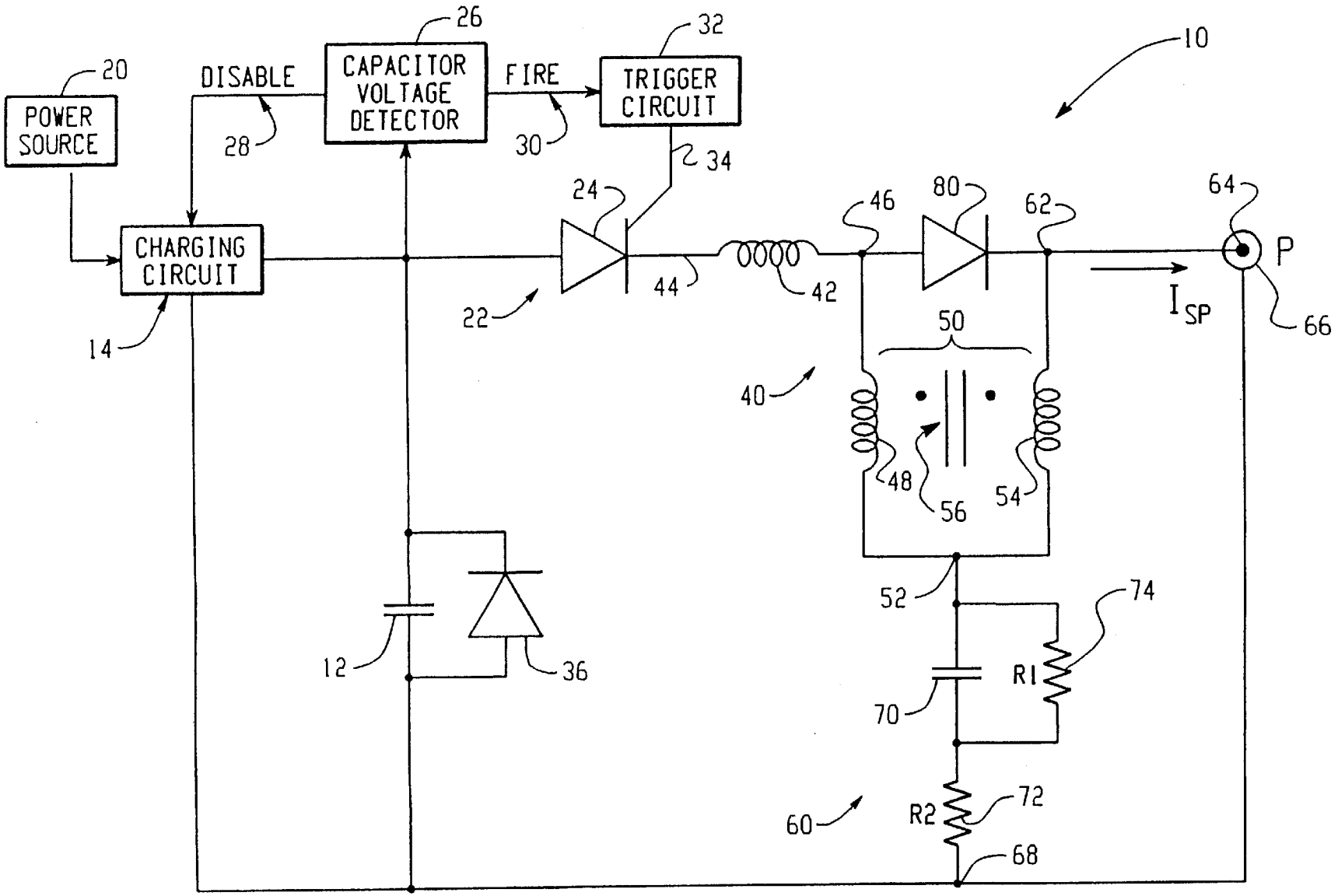
10
P
66
64
$I_{SP}$
62
80
46
42
44
24
22
40
50
54
56
48
52
74
R1
70
72
R2
68
60
36
12
TRIGGER CIRCUIT
32
34
FIRE
30
CAPACITOR VOLTAGE DETECTOR
26
DISABLE
28
CHARGING CIRCUIT
14
POWER SOURCE
20

EXCITER CIRCUIT

BACKGROUND OF THE INVENTION

The invention relates generally to ignition systems such as can be used, for example, with gas turbine engines. More particularly, the invention relates to an exciter circuit for and ignition system with the use of an output step-up transformer in the discharge circuit of the exciter.

Conventional ignition systems typically include one or more igniters through which energy is discharged from an energy storage device such as a capacitor. The discharge is characterized by a high energy spark or plasma discharge that occurs following a high voltage ionization or breakdown across the igniter gap, including air gap and semiconductor gap igniter plugs.

A conventional ignition system for an internal combustion engine, such as, for example, a gas turbine aircraft engine, includes a charging circuit, a storage capacitor, a switching circuit, a discharge circuit and at least one igniter plug located in the combustion chamber. The switching circuit may include one or more switching devices connected in series between the capacitor and the discharge circuit and plug.

In a high voltage exciter circuit, such as is typically associated with the use of air gap and semiconductor igniter plugs, it is generally known to use a step-up transformer as part of the discharge circuit. A typical system is illustrated in U.S. Pat. No. 5,510,952 issued to Bonavia et al. In some applications, however, it is desired to minimize or eliminate the presence of the step-up transformer impedance in the discharge circuit after the spark discharge is initiated. One such attempt is illustrated in U.S. Pat. No. 5,084,800 issued to Hijikata. This effort falls short, however, of eliminating the transformer impedance from the discharge circuit during the spark discharge interval.

The objectives exist, therefore, for an exciter discharge circuit that provides a high voltage for an igniter plug but which exhibits no transformer impedance during the spark discharge period.

SUMMARY OF THE INVENTION

Accordingly, the invention contemplates, in one embodiment, an ignition system exciter circuit that includes a storage capacitor; a charging circuit for charging the capacitor; a discharge circuit connectable to an igniter plug; and a first switching circuit for controlling discharge of the capacitor through the discharge circuit and plug; the discharge circuit comprising a step-up transformer for transforming voltage stored on the capacitor to a higher voltage across the igniter plug when the first switching circuit is closed; the transformer having a primary winding and a secondary winding, with the secondary winding having a first terminal that can be coupled to a first terminal of the igniter plug and a second terminal that can be coupled to a second terminal of the igniter plug; and a second switching circuit that is responsive to a voltage transition across the igniter plug and that prevents the transformer primary and secondary windings from conducting spark discharge current.

These and other aspects and advantages of the present invention will be readily understood and appreciated by those skilled in the art from the following detailed description of the preferred embodiments with the best mode contemplated for practicing the invention in view of the accompanying drawings.

BRIEF DESCRIPTION OF THE DRAWING

The drawing is an electrical schematic in primarily functional block diagram form of an ignition system and exciter circuit according to the present invention.

DETAILED DESCRIPTION OF THE INVENTION

With reference to the drawing, a schematic functional block diagram of an embodiment of an exciter circuit for an ignition system in accordance with the invention is generally designated by the numeral 10. Although an embodiment of the invention is described herein with respect to a specific form or configuration of an exciter circuit in combination with a specific type of ignition system, this description is intended to be exemplary and should not be construed in a limiting sense. Those skilled in the art will readily appreciate that the advantages and benefits of the invention can be realized with many different types of ignition systems and exciter circuit designs including, but not limited to, unidirectional discharge, AC and/or DC charging systems, capacitive and other discharge configurations, spark gap and solid-state switching circuits, high tension and low tension discharge circuits, and so on, to name just a few of the many different ignition systems and exciter circuit configurations. Furthermore, the invention can be used in combination with ignition systems for many different types of engines including internal combustion engines, rocket engines and so on, although the description herein is with specific reference to an ignition system for use with a gas turbine engine particularly well-suited for use in aerospace applications.

The exemplary exciter circuit 10 includes a main storage capacitance or capacitor 12 that is connected to a charging circuit 14. The charging circuit 14 receives input power from a power source 20, such as, for example, a DC voltage supply from the engine power plant (in the case of an AC circuit, for example, the source 20 could be an output from the engine alternator.) The charging circuit 14 can be an AC or DC charging source depending on the particular requirements for each application. The charging circuit 14 design can be conventional, such as a DC converter or a continuous AC supply circuit, for example. Suitable charging systems are described in U.S. Pat. Nos. 5,488,536; 5,510,952 and 5,530,617; all of which are issued to Bonavia et at. and owned in common by the assignee of the present invention, the entire disclosures of which are all fully incorporated herein by reference.

The capacitor 12 is also connected to one side of a switching circuit 22. In this embodiment, the switching circuit 22 includes a switching device 24 such as a solid state switch or a spark gap device. The switching device 24 can be realized many different ways such as in the form of a spark gap, a gated spark gap, gated solid state switches such as SCR, GTO or MCT devices, either single or cascaded, and so on. In the embodiment shown herein, a single SCR such as part no. N060RH15 available from Westcode Semiconductor, Inc. is used. Alternatively, a suitable spark gap device is part no. 85942 available from Simmonds Precision Engine Systems, Inc.

The switching circuit 22 further includes control logic for triggering the switching device 24 at the appropriate times. In this embodiment, the control logic includes a comparator circuit 26 that is used to sense the voltage charge on the capacitor 12. When the voltage reaches a predetermined level, the comparator circuit 26 issues a FIRE signal 30 which is received by a trigger circuit 32. The trigger circuit 32, in response to the FIRE signal 30, produces an appropriate trigger signal 34 to the switching device 24 control input, such as, for example, the gate of an SCR.

In the embodiment herein, the charging circuit 14 is realized in the form of a high frequency DC to DC converter. When a regenerative device such as an SCR is used for the switching device 24, the charging circuit is interrupted during the spark discharge period and remains off for a short time period to allow the SCR switch 24 to recover to a blocking state. The comparator circuit 26 in this case issues a DISABLE signal 28 to interrupt operation of the charging circuit 14. In alternative embodiments, the DISABLE signal 28 can be omitted. For example, if a lower frequency AC charging circuit is used, the low frequency can permit sufficient time for the SCR to recover to a blocking state. If an MCT type switching device 24 is used, an MCT can be triggered off even when current is flowing through the device. Other alternatives will be readily apparent to those skilled in the art.

In the embodiment herein, the SCR 24 is triggered on to close the switching device as soon as the capacitor 12 is charged to an appropriate predetermined level. Those skilled in the art will readily recognize this as a "wait and charge" timing arrangement, but other timing sequences such as "charge and wait", for example, could easily be used with the invention. For example, the control logic can trigger the switch 24 closed after the capacitor reaches a predetermined charge level. When the switching device 24 is closed, the capacitor 12 is coupled by the switching device 24 low impedance to the discharge circuit 40, in this case through the inductor 42, so that energy stored in the capacitor 12 is applied to the primary winding 48 of the transformer 50. In other alternative embodiments, the control logic can trigger the switching device 24 at a predetermined rate based on the desired spark rate. Other spark rate timing circuits and techniques will be readily apparent to those skilled in the art.

A free wheeling diode 36 is placed in parallel relationship to the capacitor 12 to minimize or eliminate potentially damaging reverse ringing currents and to help insure a unipolar discharge current through the igniter plug. The actual location of the diode 36 in the exciter 10 depends on the overall exciter design. For example, the free wheeling diode 36 often is placed on the cathode side of the switching device 24. This is particularly useful when an inductor is placed on the plug side of the SCR switching device 24 as in the drawing. When the inductor 42 is placed on the anode side of the switching device 24, the diode 36 should be placed as shown in the drawing.

Those skilled in the are will readily understand that various references herein to "anode side" and "cathode side", "plug side" and so on are reference terms based on the exemplary embodiment of the drawing, and that the topology selected for any particular application will determine selectable locations for various components of the exciter circuit 10 such as the free-wheeling diode 36, the switching device 24, and the capacitor 12. The present invention is directed to the incorporation of a discharge circuit as described herein, which can be used with many different topologies and exciter circuit designs.

In this embodiment, the cathode of the switching device 24 is connected to a discharge circuit 40. The discharge circuit 40 in this case includes an inductor 42 that is connected at a first terminal 44. to the switching device 24 cathode, and at a second terminal 46 to one end of a primary winding 48 of an output pulse transformer 50. In this embodiment, the inductor 42 is an air core inductor which is used as a current limiting device to prevent excessively high discharge currents through the switching device 24. Alternatively, a saturable core inductor can be used, or the inductor can be omitted when the selected switching device 24 does not require peak current protection. Yet a further alternative would be to incorporate the inductance into the design of the capacitor 12 itself. Some types of switching devices, for example an MCT, are capable of handling very high current transitions and levels. When such devices are used with the present invention, the air core inductor can possibly be omitted, or relocated in the exciter 10. For example, the inductor could be disposed between the capacitor 12 and the anode of the switching device 24; or can be disposed between the node 46 and the anode of the diode 80 (to be described hereinafter); or disposed between the cathode of the diode 80 and the plug terminal 64, to name a few examples of different topologies.

Those skilled in the art will also readily appreciate that the illustrated topology of the capacitor 12 and switching device 24 configuration can be changed. For example, the capacitor 12 and switching device 24 could be positionally interchanged from the configuration illustrated in the drawing. The switching device 24 could also be located in the return path from the plug 66 as another example. Thus, the present invention is not limited to any particular configuration or topology of the exciter design, but rather is more generally directed to the incorporation of a discharge circuit using a step-up transformer and diode in accordance with the invention as described hereinafter.

The primary winding 48 of the pulse transformer 50 is connected at its other end to a node 52 which is a connection node for an impedance circuit 60 and one end of a secondary winding 54 of the transformer 50. Although in the illustrated embodiment the transformer 50 is shown as having a core 56, a coreless transformer can also be used depending on the particular application.

The other end of the secondary winding 54 is connected to a node 62. The node 62 is a connection point for one terminal 64 of an igniter plug P. In this embodiment, the igniter plug P is a semiconductor plug, such as part no. YB63 available from Auburn Ignition Products. Other plugs, including air gap plugs, for example, well known to those skilled in the art can be used and largely will be determined by the engine design for each application.

The impedance circuit 60 is connected at one end to the transformer 50 common node 52, and at the other end to a node 68. The node 68 is the common or return line for the exciter 10, and also is connected to the other terminal 66 of the igniter plug P. The impedance circuit 60, in this embodiment, includes a trigger capacitor 70 and one or more resistors (R1 and R2 being shown in the exemplary drawing). The trigger capacitor 70 quickly charges in response to primary current in the transformer 50 when the switching device 24 initially closes. The trigger capacitor 70 blocks DC current flow through the primary winding 48 once the igniter plug ionizes (begins to discharge the capacitor 12). A resistor 74 (R1) is placed in parallel with the trigger capacitor 70 and a resistor 72 (R2) is placed in series with the trigger capacitor 70, to damp ringing when the switching device 24 initially turns on, and also to serve as a discharge path for the capacitor 70 during normal operation and as a discharge path for C1 when a spark discharge does not occur.

The illustrated locations of the trigger capacitor 70 and the resistors R1 and R2 are not exclusive. Those skilled in the art will appreciate that the capacitor 70 and resistor R2 could be placed in series between the node 46 and the top end of the primary winding 48, with the resistor R1 disposed between the node 68 and the lower end of the secondary winding 54, as one example. Alternatively, the resistors R1 and R2 can be incorporated into the respective winding resistance of the primary and secondary windings 48, 54. In some applications, the impedance circuit 60 can be omitted altogether. Still further, in applications that use the exciter 10 to energize a plurality of igniter plugs P, a diode can be placed between the node 52 and the impedance circuit 60, so that a single impedance circuit 60 could be used with a plurality of step-up transformers (one for each of the plurality of plugs) each essentially connected in parallel with the impedance circuit 60.

In accordance with an important aspect of the invention, a switching device 80, in this embodiment realized in the form of a rectifier or diode, is connected between the primary and secondary windings of the transformer 50. The rectifier 80 anode is connected to the node 46 and the output end of the inductor 42 (thereby being coupled to the output end of the switching device 24). The rectifier 80 cathode is connected to the igniter plug P at the node 62. Thus, the rectifier 80 is coupled between the switching device 24 and the igniter plug P to form a series connection therebetween. The spark discharge current, $I_{SP}$, therefore, flows through the rectifier 80 but the rectifier 80 prevents the spark discharge current from flowing through the primary or secondary windings of the transformer 50, effectively removing the transformer impedance from the spark discharge path. In high voltage and/or current applications, a series and/or parallel string of rectifiers can be used for the rectifier 80. Active switching devices can alternatively be used for the rectifier 80, for example, and other alternative switching devices 80 will be readily apparent to those skilled in the art.

In operation, with the switching device 24 initially an open circuit in an OFF condition, the charging circuit 14 charges the capacitor 12. When the capacitor 12 is fully charged to the predetermined level needed to produce a spark at the igniter plug P, the switching device 24 is triggered on, and the capacitor 12 voltage is impressed across the primary winding 48 of the pulse transformer 50. During the ensuing spark discharge time period, the DISABLE signal 28 is used to turn off the charging circuit 14. The DISABLE signal 28 keeps the charging circuit 14 off through the discharge period and for a minimum time period thereafter if needed to permit the switching device 24 to recover to a blocking state after the capacitor 12 has fully discharged through the igniter plug P.

After the switching device 24 closes, a large step-up voltage is induced across the secondary winding 54, and this large voltage is impressed across the gap of the igniter plug P. In the exemplary embodiment, the capacitor 12 is charged to about 1000 volts DC, and the windings ratio of the transformer 50 is about 4:1 so that the initial voltage across the igniter plug P gap is about 4000 VDC. Higher voltages may be required for air gap plugs, for example, or different types of semiconductor plugs.

Due to the large voltage transformation from the primary winding 48 to the secondary winding 54 of the transformer 50, the rectifier 80 is reversed biased and thus presents a high impedance to current flow prior to spark breakdown of the igniter plug P. In the case of a semiconductor plug, a negligible ionizing current will flow until the arc or plasma is formed across the plug electrodes. As soon as the igniter plug P ionizes, however, spark discharge current increases rapidly and the voltage across the igniter plug P falls dramatically and very rapidly, thus forward biasing the rectifier 80. For purposes of the present invention, the negligible ionizing current that flows prior to spark breakdown is not considered to be part of the spark discharge current because such ionizing current does not contribute any significant energy to the spark. The rectifier 80, in response to this voltage transition across the igniter plug P, effectively switches from an open or high impedance condition to a short circuit very low impedance condition between the igniter plug P and the capacitor 12 (as well as the inductor 42 and the switching device 24 when those devices are used in a particular application), thus effectively removing the transformer 50 impedance from the spark discharge current path. This operation is achieved in the described embodiment by having the transformer 50 secondary essentially in parallel with the igniter plug P, yet providing the rectifier 80 in such a location as to permit the spark discharge current to flow from the capacitor 12 to the plug P without impedance from the transformer 50.

It is noted that the transformer 50, in the case of a transformer with a magnetic core, will not saturate, and must not saturate in order to permit the igniter plug P to receive sufficient voltage for breakdown. Additionally, the inductor 42 can be selected to limit the peak discharge current if so required.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. An ignition system exciter circuit comprising: a storage capacitor; a charging circuit for charging the capacitor; a discharge circuit connectable to an igniter plug; and a switching circuit for controlling discharge of the capacitor through the discharge circuit and plug; said discharge circuit comprising a step-up transformer having a primary winding and a secondary winding; said secondary winding having a first terminal that can be coupled to a first terminal of the igniter plug and a second terminal that can be coupled to a second terminal of the igniter plug; said primary winding having a first terminal that receives energy from the capacitor by operation of the switching circuit; and a rectifier connected between said primary winding first terminal and said secondary winding first terminal.

2. The apparatus of claim 1 comprising an impedance circuit coupled in series with said transformer primary winding.

3. The apparatus of claim 2 wherein said impedance circuit comprises a capacitor.

4. The apparatus of claim 1 wherein said rectifier prevents spark discharge current from flowing through said transformer primary and secondary windings.

5. The apparatus of claim 1 comprising an inductor having a first terminal connected to said switching circuit and a second terminal connected to said primary winding first terminal.

6. The apparatus of claim 5 wherein said inductor comprises an air core inductor.

7. The apparatus of claim 1 wherein said transformer comprises a pulse transformer.

8. The apparatus of claim 7 wherein said pulse transformer comprises a core which magnetically couples said primary and secondary windings, wherein said core is unsaturated throughout a time period during which the capacitor discharges through the igniter plug.

9. The apparatus of claim 1 wherein the igniter plug comprises an air gap plug or a semiconductor spark plug.

10. The apparatus of claim 1 wherein the ignition system is used in a gas turbine engine.

11. The apparatus of claim 1 wherein said rectifier comprises a diode.

12. The apparatus of claim 11 wherein said rectifier comprises a string of series or parallel connected diodes.

13. An ignition system exciter circuit comprising: an energy storage capacitor; a charging circuit for charging the capacitor; a discharge circuit connectable to an igniter plug; and a first switching circuit for controlling discharge of the capacitor through the discharge circuit and plug; said discharge circuit comprising a step-up transformer having a primary winding and a secondary winding; said secondary winding having a first terminal that is connectable to a first terminal of the igniter plug and a second terminal connectable to a second terminal of the igniter plug; said primary winding having a first terminal that receives energy from the capacitor by operation of the switching circuit; and a second switching circuit connected between said primary winding first terminal and said secondary winding first terminal.

14. The apparatus of claim 13 wherein said second switching circuit comprises a diode.

15. The apparatus of claim 13 wherein said transformer comprises a pulse transformer.

16. The apparatus of claim 15 wherein said pulse transformer comprises a core which magnetically couples said primary and secondary windings, wherein said core is unsaturated throughout a time period during which the capacitor discharges through the igniter plug.

17. The apparatus of claim 13 wherein said second switching circuit produces substantially an open circuit between said primary winding first terminal and said secondary winding first terminal prior to a spark discharge at the igniter plug, and produces substantially a short circuit therebetween when the igniter plug begins to discharge.

18. An ignition system exciter circuit comprising: a storage capacitor; a charging circuit for charging the capacitor; a discharge circuit connectable to an igniter plug; and a first switching circuit for controlling discharge of the capacitor through the discharge circuit and plug; said discharge circuit comprising a step-up transformer for transforming voltage stored on the capacitor to a higher voltage across the igniter plug when the first switching circuit is closed; said transformer having a primary winding and a secondary winding, with said secondary winding having a first terminal that can be coupled to a first terminal of the igniter plug and a second terminal that can be coupled to a second terminal of the igniter plug; and a second switching circuit that is responsive to a voltage transition across the igniter plug and that prevents said transformer primary and secondary windings from conducting spark discharge current.

19. The apparatus of claim 18 wherein said second switching circuit provides a very low impedance spark discharge current path from the capacitor to the plug to remove said transformer primary and secondary windings from said spark current discharge path.

20. The apparatus of claim 18 wherein said second switching circuit comprises a rectifier which completely removes said transformer primary and secondary windings from the discharge circuit operation after the igniter plug begins to conduct spark discharge current to prevent spark discharge current from passing through said transformer primary and secondary windings.

21. The apparatus of claim 18 wherein said voltage transition is characterized by a substantial voltage drop across the igniter plug when the plug begins to conduct spark discharge current.

22. The apparatus of claim 21 wherein said second switching circuit comprises a diode that changes from a reverse bias condition to a forward bias condition in response to said voltage transition across the igniter plug.

* * * * *